US012595523B2

(12) United States Patent
Kase et al.

(10) Patent No.: US 12,595,523 B2
(45) Date of Patent: Apr. 7, 2026

(54) REFINING PROCESS CONTROL DEVICE AND REFINING PROCESS CONTROL METHOD

(71) Applicant: JFE STEEL CORPORATION, Tokyo (JP)

(72) Inventors: Hiroto Kase, Tokyo (JP); Shota Amano, Tokyo (JP); Yukio Takahashi, Tokyo (JP); Shinji Tomiyama, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 499 days.

(21) Appl. No.: 18/024,156

(22) PCT Filed: Aug. 25, 2021

(86) PCT No.: PCT/JP2021/031079
§ 371 (c)(1),
(2) Date: Mar. 1, 2023

(87) PCT Pub. No.: WO2022/050139
PCT Pub. Date: Mar. 10, 2022

(65) Prior Publication Data

US 2023/0332260 A1 Oct. 19, 2023

(30) Foreign Application Priority Data

Sep. 1, 2020 (JP) ..... 2020-146529

(51) Int. Cl.
*C21C 7/076* (2006.01)

(52) U.S. Cl.
CPC ..... *C21C 7/076* (2013.01); *C21C 2300/06* (2013.01); *C21C 2300/08* (2013.01)

(58) Field of Classification Search
CPC . C21C 7/076; C21C 2300/06; C21C 2300/08; C21C 5/4673; C21C 5/35; Y02P 10/25
(Continued)

(56) References Cited

FOREIGN PATENT DOCUMENTS

CN 105074016 A 11/2015
JP H11-061233 A 3/1999
(Continued)

OTHER PUBLICATIONS

WO 2018012257 A1 Translation (Year: 2018).*
(Continued)

*Primary Examiner* — Danielle M. Carda
(74) *Attorney, Agent, or Firm* — Oliff PLC

(57) ABSTRACT

A refining process control device includes: a past similar performance extraction unit configured to extract, from the refining performance database, a performance value of a past refining process in which a refining condition being a refining process condition acquired before the start of the refining process and including a result of an immediately preceding refining process in the refining facility, is similar to a refining process condition as a calculation target and the evaluation value is high; and an operation amount determination unit configured to determine an initial operation amount at the start of a refining process based on the performance value of the past refining process extracted by the past similar performance extraction unit, and determine an operation amount based on a change amount of the initial operation amount after the start of the refining process.

7 Claims, 3 Drawing Sheets

(58) Field of Classification Search
USPC ..... 75/507
See application file for complete search history.

(56) References Cited

FOREIGN PATENT DOCUMENTS

| | | | | |
|---|---|---|---|---|
| JP | 2010-033536 | A | 2/2010 | |
| JP | 5211895 | B2 | 6/2013 | |
| JP | 2015-168870 | A | 9/2015 | |
| JP | 2017-115216 | A | 6/2017 | |
| JP | 2018-178199 | A | 11/2018 | |
| JP | 2018-178200 | A | 11/2018 | |
| JP | 2019-014964 | A | 1/2019 | |
| JP | 2020-015959 | A | 1/2020 | |
| RU | 2 017 830 | C1 | 8/1994 | |
| SU | 916548 | A1 | 3/1982 | |
| TW | 201920691 | A | 6/2019 | |
| WO | WO-2018012257 | A1 * | 1/2018 | ..... C21C 5/46 |

OTHER PUBLICATIONS

Nov. 9, 2021 International Search Report issued in Patent Application No. PCT/JP2021/031079.
May 9, 2022 Office Action issued in Taiwan Patent Application No. 110132004.
Sep. 28, 2023 Office Action issued in Russian Patent Application No. 2023107568.
Jan. 30, 2024 extended Search Report issued in European Patent Application No. 21864197.5.
Jan. 26, 2025 Office Action issued in Chinese Patent Application No. 202180052135.0.

* cited by examiner

REFINING PROCESS CONTROL DEVICE AND REFINING PROCESS CONTROL METHOD

FIELD

The present invention relates to a refining process control device and a refining process control method in a refining facility of a steel industry.

BACKGROUND

In ironworks, components and temperature of molten iron extracted from a blast furnace are adjusted in refining facilities such as a pretreatment facility, a converter, and a secondary refining facility. In these refining facilities, it is very important to accurately adjust the components and the temperature of the molten metal after the process to target values and improve the efficiency of the process from the viewpoint of quality control of steel and economy in the cost of refining. Conditions and environments of the refining process such as the component and temperature of the molten iron and the state of the refining facility vary in the control of the component and temperature of the molten metal in the refining facility. Furthermore, in the case of a converter, for example, the operation amount in the refining process is determined by an infinite number of combinations such as a top-blown oxygen flow rate and a rate, a top-blown lance height, a bottom-blow gas flow rate, a charge amount and charge timing of sub-raw materials such as lime and iron ore. In the refining process as described above, it has been difficult to appropriately control the operation amount determined by an infinite number of combinations for various processing conditions and processing environments, causing a problem of variation in the process due to this difficulty in the control. In order to solve such a problem, Patent Literature 1 describes a method in a dephosphorization processing method using a converter type refining furnace, by which a variation in P concentration in molten metal after the process is to be suppressed by changing an operation amount such that a state amount including oxygen efficiency for decarburization follows a target change curve preset for each process pattern.

CITATION LIST

Patent Literature

Patent Literature 1: JP 5211895 B

SUMMARY

Technical Problem

The method described in Patent Literature 1 performs a process of several charges in advance for each same process pattern, and sets a target change curve based on a performance of the charge that has achieved satisfactory dephosphorization, which takes the influence of the process pattern in consideration. However, the method described in Patent Literature 1 does not consider the influence of the conditions of the refining process and the environment such as the component and temperature of the molten iron input into the refining furnace, the amount of slag carried over from the immediately preceding process, and the state of the refining furnace. In the refining process, even when the process is performed in the same pattern, the state of change in the reaction amount and the state amount greatly varies depending on the conditions of the molten iron and the refining furnace. Therefore, there is a possibility that the variation for each process cannot be reduced by the method described in Patent Literature 1 due to the reason that the set target change curve is not optimal.

The present invention has been made in view of the above problem, and aims to provide a refining process control device and a refining process control method capable of reducing variations for each process.

Solution to Problem

A refining process control device according to the present invention includes: a model calculation unit configured to acquire, as input information, a performance value of a refining process condition in a refining facility, a measurement result of a temperature and a component concentration of a molten metal in the refining facility, measurement results related to a refining facility, including a flow rate of an exhaust gas discharged from the refining facility and a component concentration in the exhaust gas, and a result of an immediately preceding refining process in the refining facility, and calculates a reaction amount and a state amount in the refining facility during the refining process using the acquired input information; a refining process evaluation calculation unit configured to calculate an evaluation value of the refining process using the input information acquired by the model calculation unit or past input information; a refining performance database configured to store the input information acquired by the model calculation unit, the reaction amount and the state amount calculated by the model calculation unit, and the evaluation value calculated by the refining process evaluation calculation unit; a past similar performance extraction unit configured to extract, from the refining performance database, a performance value of a past refining process in which a refining condition being a refining process condition acquired before the start of the refining process and including a result of an immediately preceding refining process in the refining facility, is similar to a refining process condition as a calculation target and the evaluation value is high; and an operation amount determination unit configured to determine an initial operation amount at the start of a refining process based on the performance value of the past refining process extracted by the past similar performance extraction unit, and determine an operation amount based on a change amount of the initial operation amount after the start of the refining process.

The result of the immediately preceding refining process in the refining facility may include: a molten metal temperature after the immediately preceding refining process; a refining process result including a molten metal component and a slag component; an elapsed time from the end of the immediately preceding refining process to the start of the target refining process; and information regarding a process performed during the elapsed time.

The input information may include information related to a state of the refining facility including the number of times of use of the refining facility.

The refining process evaluation calculation unit may be configured to calculate the evaluation value based on a cost of a sub-raw material charged during the refining process, a difference between a performance value and a target value of a temperature and a component concentration of the molten metal after the refining process, and an index representing refining process efficiency.

The past similar performance extraction unit may be configured to calculate a distance between a vector representing features of the refining process condition and the refining process performance acquired before starting the refining process and a vector representing features of the refining process condition and the refining process performance as a calculation target, and extracts a performance value of a past refining process close in distance.

The operation amount determination unit may be configured to determine an initial operation amount based on a past refining process result including a molten metal temperature change amount and a molten metal component change amount and a past operation amount performance, which have been extracted by the past similar performance extraction unit, and determine the operation amount, after start of the refining process, by changing the operation amount to follow transition of a reaction amount and a state amount during the refining process in the past refining performance extracted by the past similar performance extraction unit.

A refining process control method according to the present invention includes: a model calculation step of acquiring, as input information, a performance value of a refining process condition in a refining facility, a measurement result of a temperature and a component concentration of a molten metal in the refining facility, measurement results related to a refining facility, including a flow rate of an exhaust gas discharged from the refining facility and a component concentration in the exhaust gas, and a result of an immediately preceding refining process in the refining facility, and calculating a reaction amount and a state amount in the refining facility during the refining process using the acquired input information; a refining process evaluation calculation step of calculating an evaluation value of the refining process using the input information acquired by the model calculation step or past input information; a storing step of storing, into a refining performance database, the input information acquired by the model calculation step, the reaction amount and the state amount calculated by the model calculation step, and the evaluation value calculated by the refining process evaluation calculation step; a past similar performance extraction step of extracting, from the refining performance database, a performance value of a past refining process in which a refining condition being a refining process condition acquired before the start of the refining process and including a result of an immediately preceding refining process in the refining facility, is similar to a refining process condition as a calculation target and the evaluation value is high; and an operation amount determination step of determining an initial operation amount at the start of a refining process based on the performance value of the past refining process extracted by the past similar performance extraction step, and determining an operation amount based on a change amount of the initial operation amount after the start of the refining process.

Advantageous Effects of Invention

According to the refining process control device and the refining process control method according to the present invention, it is possible to reduce variations for each process.

DESCRIPTION OF EMBODIMENTS

Hereinafter, a configuration and operation of a refining process control device according to an embodiment of the present invention will be described in detail with reference to the drawings.

[Configuration]

First, a configuration of a refining process control device according to an embodiment of the present invention will be described with reference to FIG. 1.

Figure 1:
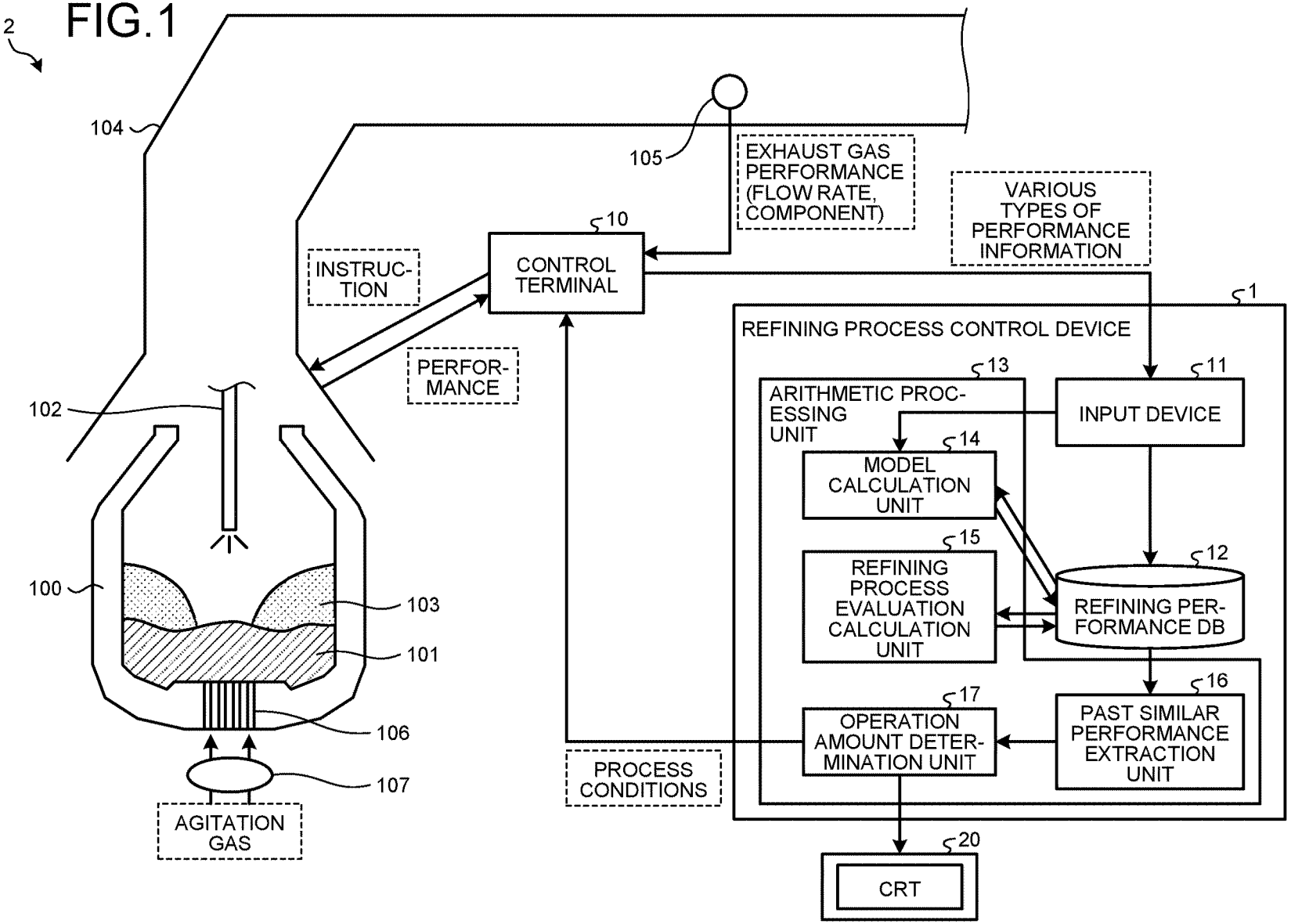
FIG. 1 is a schematic diagram illustrating a configuration of a refining process control device according to an embodiment of the present invention.

FIG. 1 is a schematic diagram illustrating a configuration of a refining process control device according to an embodiment of the present invention. As illustrated in FIG. 1, a refining process control device 1 according to an embodiment of the present invention is a device that controls a component concentration and a temperature of a molten metal 101 processed in a refining facility 2 of a steel industry, and controls a component concentration of a slag 103. Here, the refining facility 2 includes a converter 100, a lance 102, and a duct 104. The lance 102 is disposed on the molten metal 101 in the converter 100. High-pressure oxygen is injected from a tip of the lance 102 toward the molten metal 101 at a lower position. Impurities in the molten metal 101 are oxidized by the high-pressure oxygen and taken into the slag 103 (refining process). The duct 104 for exhaust gas smoke guiding is installed in an upper portion of the converter 100.

The duct 104 internally includes an exhaust gas detection unit 105. The exhaust gas detection unit 105 detects a flow rate of the exhaust gas and a component (for example, CO, $CO_2$, $O_2$, $N_2$, $H_2O$, Ar. or the like) of the exhaust gas, discharged during the refining process. The exhaust gas detection unit 105 measures the flow rate of the exhaust gas in the duct 104 based on a differential pressure between positions before and after the Venturi tube provided in the duct 104, for example. In addition, the exhaust gas detection unit 105 measures the concentration [%] of each component in the exhaust gas. The flow rate and the component concentration of the exhaust gas are measured in a period of several seconds, for example. A signal indicating the detection result of the exhaust gas detection unit 105 is transmitted to a control terminal 10.

An agitation gas is blown onto the molten metal 101 in the converter 100 through a vent hole 106 formed in the bottom of the converter 100. The agitation gas is an inert gas such as Ar or $N_2$. The blown agitation gas agitates the molten metal 101 to accelerate the reaction between the high-pressure oxygen and the molten metal 101. A flowmeter 107 measures the flow rate of the agitation gas blown into the converter 100. At times immediately preceding the start of blowing and after the blowing, the temperature and component concentration of the molten metal 101 are analyzed. The temperature and the component concentration of the molten metal 101 are measured once or a plurality of times during blowing. The supply amount (oxygen feeding amount) and the rate (oxygen feeding rate) of the high-pressure oxygen, the flow rate of the agitation gas (agitation gas flow rate), and the like are determined based on the measured temperature and component concentration.

A refining process control system to which the refining process control device 1 and the refining process control method are applied include the control terminal 10, the refining process control device 1, and a display device (CRT) 20 as main components. The control terminal 10 includes an information processing device such as a personal computer or a workstation. The control terminal controls the oxygen feeding amount, the oxygen feeding rate, and the agitation gas flow rate so that the component concentration and the temperature of the molten metal 101 fall within desired ranges, and collects data of performance values regarding the oxygen feeding amount, the oxygen feeding rate, and the agitation gas flow rate.

The refining process control device 1 includes an information processing device such as a personal computer or a workstation. The refining process control device 1 includes an input device 11, a refining performance database (refining performance DB) 12, and an arithmetic processing unit 13. The arithmetic processing unit 13 functions as a model calculation unit 14, a refining process evaluation calculation unit 15, a past similar performance extraction unit 16, and an operation amount determination unit 17.

The input device 11 is an input interface from which various measurement results and track performance information related to the refining facility 2 are input. Examples of the input device 11 include a keyboard, a mouse, a pointing device, a data receiving device, and a graphical user interface (GUI). The input device 11 receives the performance data, the parameter setting values, and the like from the outside, writes the information in the refining performance DB 12, and transmits the information to the model calculation unit 14. The refining process conditions and the refining performance information are input from the control terminal 10 to the input device 11. Example of the refining process conditions include a standard or a target value related to the component and temperature after the refining process of the molten metal 101, restrictions related to the brand of the sub-raw material to be charged and the charge amount of the sub-raw material, information regarding the processes of the subsequent or later steps for the molten metal 101 after the refining process, the specification of the lance 102 to be used, the position and number of vent holes 106, and information regarding preset change patterns of the height the lance 102 and the oxygen feeding amount. Examples of the refining performance information include: a measurement result of the component concentration and the temperature of the molten metal 101; a refining facility-related measurement result, which includes the flow rate of the exhaust gas and the components of the exhaust gas output from the exhaust gas detection unit 105; the performance of the operation amount including the oxygen feeding amount and the oxygen feeding rate, the agitation gas flow rate, and the charge amount of the raw material (main raw material and sub-raw material); information regarding the state of the refining facility including the number of times of use of the refining furnace in the refining facility; the component concentration and the temperature of the molten metal 101 after an immediately preceding refining process; a processing result including the amount and the composition of the slag 103; an elapsed time from the end of the immediately preceding refining process to the start of the target refining process, and information regarding the process performed during the elapsed time. Examples of the information regarding the process performed in a period from the end of the immediately preceding refining process to the start of the target refining process include: the presence or absence of the implementation of a refractory protection process in the furnace as well as the amount of refractory protective materials used at the time of the implementation; the charge amount of a sub-raw material for solidifying the molten metal 101; the presence or absence of the implementation of the oxygen feeding process for dissolving the adhesion including an iron component in the vicinity of the furnace throat and the furnace bottom; and the oxygen feeding amount at the time of the implementation as well as the presence or absence of the implementation of the process of removing the adhesion in the upper part of the furnace throat, as well as the amount of the adhesion removed at the time of the implementation.

The refining performance DB 12 is a storage device that stores the refining process conditions and the refining performance information regarding the refining process input to the input device 11, calculation results of an in-furnace reaction amount and an in-furnace state amount output from the model calculation unit 14, and the refining process evaluation value output from the refining process evaluation calculation unit 15. The data storage period of the refining performance DB 12 is preferably at least half a year or more.

The arithmetic processing unit 13 is an arithmetic processing device such as a CPU, and controls the entire operation of the refining process control device 1. The arithmetic processing unit 13 has functions as the model calculation unit 14, the refining process evaluation calculation unit 15, the past similar performance extraction unit 16, and the operation amount determination unit 17. The model calculation unit 14, the refining process evaluation calculation unit 15, the past similar performance extraction unit 16, and the operation amount determination unit 17 are implemented by the arithmetic processing unit 13 executing a computer program, for example. The arithmetic processing unit 13 functions as the model calculation unit 14 by executing a computer program for the model calculation unit 14, functions as the refining process evaluation calculation unit 15 by executing a computer program for the refining process evaluation calculation unit 15, functions as the past similar performance extraction unit 16 by executing a computer program applicable for the past similar performance extraction unit 16, and functions as the operation amount determination unit 17 by executing a computer program for the operation amount determination unit 17. The arithmetic processing unit 13 may include a dedicated arithmetic device or an arithmetic circuit that each functions as the model calculation unit 14, the refining process evaluation calculation unit 15, the past similar performance extraction unit 16, or the operation amount determination unit 17.

The model calculation unit 14 calculates the in-furnace reaction amount and the in-furnace state amount based on the information transmitted from the input device 11 and the information stored in the refining performance DB 12. Examples of the in-furnace reaction amount include the amount of C oxidation in the molten metal, the amount of Si oxidation in the molten metal, the amount of Mn oxidation and reduction in the molten metal, the amount of P oxidation and reduction in the molten metal, the amount of Fe oxidation and reduction in the molten metal, and the amount of CO oxidation in the furnace. Examples of the in-furnace state amount include the molten metal temperature, the molten metal component, the slag component, the amount of molten metal C oxidation per unit oxygen (oxygen efficiency for decarburization), the slag-metal P equilibrium constant, the slag weight, the in-furnace slag level, the agitating power applied on the molten metal 101, and the reaction field area (ignition point area) between the top-blown oxygen gas and the molten metal 101. After acquiring the refining process result, the model calculation unit 14 calculates an in-furnace reaction amount and an in-furnace state amount for a plurality of certain elapsed time points in one refining process. The model calculation unit 14 may perform calculation processing at a certain cycle during the refining process. The calculation result of the model calculation unit 14 is stored in the refining performance DB 12.

The refining process evaluation calculation unit calculates an evaluation value (refining process evaluation value) of refining process performance based on the information stored in the refining performance DB 12. The refining process evaluation calculation is automatically executed at a point of acquisition of information necessary for the refining process evaluation calculation including the refining process result, or is executed by an operation by the operator to input an execution command to the control terminal 10. The refining process evaluation value can be calculated using an evaluation function illustrated in the following Formula (1), for example.

$$\text{Evaluation function}=\Sigma_i(A_i\times|\text{Molten metal component performance } i[\%]-\text{Target molten metal component } i[\%]|)+B\times|\text{Molten metal temperature performance [° C.]}-\text{Target molten metal temperature [° C.]}|+\Sigma_j(C_j\times\text{Sub-Raw material brand charge amount for each occasion } j[\text{kg}/t])-D\times\text{Molten metal } C \text{ oxidation amount}[\%]/\text{Oxygen feeding amount}[\text{Nm}^3/t]-E\times\text{Molten metal Si oxidation amount}[\%]/\text{Oxygen feeding amount}[\text{Nm}^3/t]-F\times\text{Molten metal } P \text{ oxidation amount}[\%]/\text{T}\cdot\text{CaO}[\text{kg}/t] \quad (1)$$

Here, i is the number of molten metal components managed in the refining process, including the C concentration in the molten metal, the Si concentration in the molten metal, the Mn concentration in the molten metal, and the P concentration in the molten metal, j is the number of brands of sub-raw materials charged into the refining process, T·CaO is an integrated value of CaO components in the sub-raw materials that have been charged into the refining process, and A to F are parameters for weighting each term. When A to F are all set to positive values, the Formula (1) indicates that the lower the calculated value of the evaluation function, the better the refining process is. In addition, when the values of A to F have been changed, the refining process evaluation value is recalculated for the past refining performance. The calculation result of the refining process evaluation calculation unit 15 is stored in the refining performance DB 12.

Based on the information stored in the refining performance DB 12, the past similar performance extraction unit 16 extracts a past refining performance in which the refining process condition acquired before the start of the refining process is similar to the refining process condition as a calculation target and the refining process evaluation value is high. The extraction of the past refining performance is executed automatically or by an operator inputting an execution command to the control terminal 10 before the start of the refining process as a calculation target and after the acquisition of the refining process condition information necessary for the past similar performance extraction calculation. The extracted past performance information is output to the operation amount determination unit 17.

Based on the past refining performance information extracted by the past similar performance extraction unit 16, the operation amount determination unit 17 determines an operation amount as a calculation target and outputs the determined operation amount to the control terminal 10. Examples of the operation amount to be determined include the oxygen feeding amount and the oxygen feeding rate, the height of the lance 102, the flow rate of the agitation gas, and the charge amount of the sub-raw material. After the start of the refining process, the refining process control is performed based on the operation amount output from the operation amount determination unit 17. The operation amount determination unit 17 also has a function of outputting past refining performance information and a calculation target operation amount to the display device 20 to display guidance for refining process control.

The refining process control device 1 having such a configuration executes the control process described below to determine the operation amount and accurately perform the refining process control, thereby reducing variations for each process. Hereinafter, the operation of the refining process control device 1 when executing the control process will be described with reference to the flowchart illustrated in FIG. 2.

[Control Process]

Figure 2:
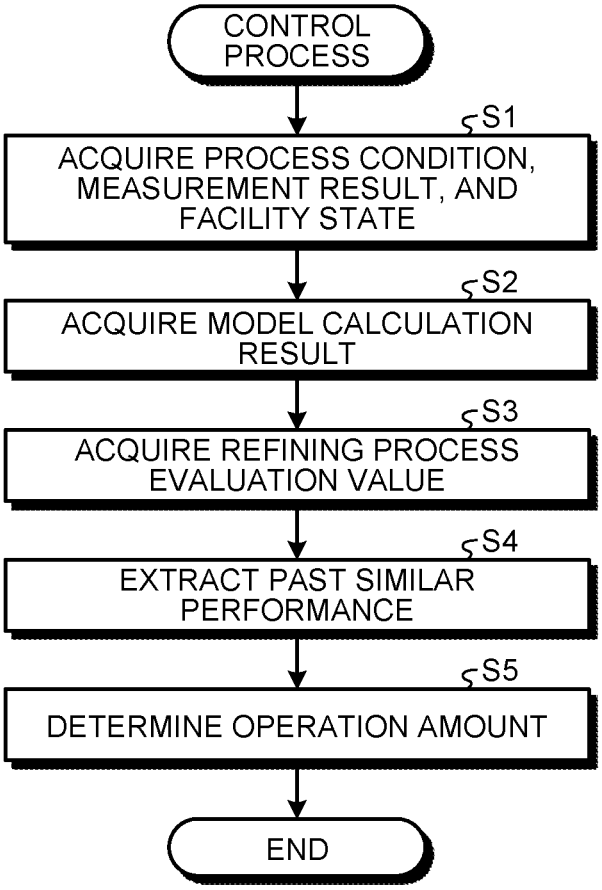
FIG. 2 is a flowchart illustrating a flow of a control process according to an embodiment of the present invention.

FIG. 2 is a flowchart illustrating a flow of a control process according to an embodiment of the present invention. The flowchart illustrated in FIG. 2 starts automatically or when the operator inputs an execution command to the control terminal 10 before the start of the refining process as a calculation target and after the acquisition of the refining process condition information necessary for the calculation process in the past similar performance extraction unit 16, and the control process proceeds to the process of Step S1.

In the process of Step S1, the arithmetic processing unit 13 acquires, from the input device 11 and the refining performance DB 12, pieces of information necessary for the calculation process in the past similar performance extraction unit 16. The information to be acquired include: the standard or target value related to the component and temperature after the refining process of the molten metal 101; restrictions related to the brand of the sub-raw material to be charged and the charge amount of the sub-raw material; information regarding the processes of the subsequent or later steps for the molten metal 101 after the refining process; the specification of the lance 102 to be used; the position and number of the vent holes 106; the refining process conditions including the information regarding the preset the change patterns of the height of the lance 102 and the oxygen feeding amount; the measurement result of the component concentration and the temperature of the molten metal 101; the refining facility-related measurement result including the flow rate of the exhaust gas and the component concentration in the exhaust gas output from the exhaust gas detection unit 105; the oxygen feeding amount and the oxygen feeding rate; the agitation gas flow rate; the performance of the operation amount including the charge amount of the raw material (main raw material and sub-raw material); information related to the state of the refining facility, including the number of times of use of the refining furnace in the refining facility; the component concentration and the temperature of the molten metal 101 after an immediately preceding refining process; processing results including the amount and composition of slag; the elapsed time from the end of the immediately preceding refining process to the start of the target refining process; and information regarding the process performed from the end of the immediately preceding refining process to the start of the target refining process. This completes the process of Step S1, and the control process proceeds to the process of Step S2.

In the process of Step S2, the arithmetic processing unit 13 acquires the in-furnace reaction amount and the in-furnace state amount in the refining process calculated by the model calculation unit 14. The model calculation result to be acquired corresponds to the past refining process result used in the past similar performance extraction step in Step S4. This completes the process of Step S2, and the control process proceeds to the process of Step S3.

In the process of Step S3, the arithmetic processing unit 13 acquires the refining process evaluation value in the past refining process calculated by the refining process evaluation calculation unit 15. The refining process evaluation value to be acquired corresponds to the past refining process result used in the past similar performance extraction step in Step S4. This completes the process of Step S3, and the control process proceeds to the process of Step S4.

In the process of Step S4, from among the information acquired by the processes of Steps S1 to S3, the past similar performance extraction unit 16 extracts a past refining performance in which the refining process condition and the refining process performance acquired before the start of the refining process are similar to the refining process condition and the refining process performance as a calculation target and the refining process evaluation value is high. The similarity between the refining process condition to be calculated and the past refining performance can be evaluated by calculating the Euclidean distance illustrated in the following Formula (2), for example.

$$\text{Similarity}=(\Sigma_k((\text{Past performance condition } k-\text{Target process condition } k)\hat{}2/G_k\hat{}2))\hat{}0.5 \quad (2)$$

Here, k is the number of refining process conditions and refining process performances, while $G_k$ is a parameter for weighting each refining process condition and refining process performance. Examples of the refining process conditions and refining process performance include: the date and time of the refining process; the weight of the molten iron to be input; the weight of the scrap to be input; the temperature of the molten iron; the component concentration of substances such as C, Si, Mn, and P in the molten iron: the standard or target value regarding the component and the temperature of the molten metal 101 after the refining process; the number of times of use of the refining furnace and the top-blowing lance; the temperature of the molten metal after the process in an immediately preceding refining process and the elapsed time after the process; information regarding the temperature change due to the process performed after the refining process such as the sub-raw material charging process, the oxygen feeding process, and the removal of the adhesion in the upper part of the furnace throat; the weight and the component of the slag to be carried over; the charging weight of the sub-raw material which is to be charged or whose charge amount is determined before the start of the refining process; and the charging weight of each of the brand of the scrap. In addition, when the degree of similarity is evaluated, it is allowable to use, as the target, only the performance having a match in the form of the refining furnace used, the form of the lance 102, the form of the vent hole 106, and the like. Note that the similarity degree is not limited to the Euclidean distance indicated in Formula (2), and can be evaluated by a method of evaluating a distance between k-dimensional vectors including a city block distance, a Minkowski distance, a Mahalanobis distance, and a cosine similarity degree.

Here, high similarity is synonymous with a short distance between the calculated k-dimensional vectors. Extraction of the past refining performance may be in the form of extraction of past refining performance having calculated similarity higher than a set threshold, or may be extraction of any number of pieces of past refining performance having high similarity. The method of extracting similar performance may be a method of calculating, for each item of the refining process condition and the refining process performance k, differences between the refining process condition and the refining process performance of calculation target and the past refining process condition and refining process performance and then extracting the performance in which k differences are smaller than set thresholds. The process of Step S4 extracts a performance in which the refining process evaluation value acquired in the process of Step S3 is the highest or a plurality of top performances from among the past similar performances extracted by the method. This completes the process of Step S4, and the control process proceeds to the process of Step S5.

In the process of Step S5, the operation amount determination unit 17 determines the operation amount after the start of the refining process based on the information regarding the past refining performance extracted in the process of Step S4 and the calculated values of the in-furnace reaction amount and an in-furnace state amount in the past refining performance acquired in the process of Step S2. Specifically regarding the operation amount at the start of the refining process, for example, an operation amount similar to the extracted past refining performance or a condition calculated based on the extracted past performance is transmitted to the control terminal 10. Regarding the operation amount at the start of the refining process, for example, using Formula (3) below, and based on the performance of the operation amount including the temperature change amount of the molten metal 101 in the past refining performance, the refining process result including the molten metal component change amount, and the sub-raw material charge amount in the past refining performance, and based on the scheduled operation amount including the target temperature change amount of the molten metal 101 in the target refining process, the refining process target value including the target molten component, and the scheduled sub-raw material charge amount, a difference between the past refining performance and the target refining process condition is calculated, thereby calculating a corrected temperature change amount of the molten metal 101. Subsequently, the charge amount of the sub-raw material for the temperature operation of the molten metal 101, such as the coolant or the heating material, is determined to satisfy the following Formula (4).

$$\text{Corrected temperature change amount}[^\circ\text{ C.}]=\text{Target temperature change amount}[^\circ\text{ C.}]-\text{Past performance temperature change amount}[^\circ\text{ C.}]-\Sigma_i\{\alpha_i[^\circ\text{ C.}/(\text{kg}/t)]\times(\text{Scrap band } l \text{ charge amount_target}[\text{kg}/t]-\text{Scrap band } l \text{ charge amount_past}[\text{kg}/t])\}-\Sigma_m\{\beta_m[^\circ\text{ C.}/\%]\times(\text{Pre-process component } m \text{ concentration_target}[\%]-\text{Pre-process component } m \text{ concentration_past}[\%])\}-\Sigma_n\{\gamma_n[^\circ\text{ C.}/\%]\times(\text{Post-process target component } n \text{ concentration_target}[\%]-\text{Post-process conponent } n \text{ concentration_past}[\%])\}-\Sigma p\{\delta_p[^\circ\text{ C.}/(\text{kg}/t)]\times(\text{Sub-raw material brand } p \text{ scheduled charge amount_target}[\text{kg}/t]-\text{Sub-raw material brand } p \text{ charge amount_past}[\text{kg}/t])\} \quad (3)$$

$$\Sigma q\{\text{Temperature operation sub-raw material brand } q \text{ charge amount}[\text{kg}]\times\varepsilon q[^\circ\text{ C./kg}]\}=\text{Corrected temperature change amount}[^\circ\text{ C.}] \quad (4)$$

Note that, in Formulas (3) and (4), a target is an item in the target refining process, past is an item in the past refining performance, l is the number of scrap brands to be calculated, m is the number of calculation target components in the molten metal 101 or the slag 103 before the refining process, n is the number of calculation target components in the molten metal 101 or the slag 103 after the refining process, p is the number of sub-raw material brands as a calculation target, and α, β, γ, and δ are constants for individual calculation items regarding a difference between the past refining performance and the target refining process condition. Examples of the pre-refining process calculation target component m include C, Si, Mn, and P in the molten metal 101. Examples of the post-refining process calculation target component n include C, Si, Mn, P, and O in the molten metal 101 and FeO and $Fe_2O_3$, etc. in the slag 103. Examples of the calculation target sub-raw material brand p include a lime source, a coolant, a heating material, and a refractory protective material. The temperature operation sub-raw material brand q is a coolant or a heating material, and ε represents a cooling or heating coefficient of the temperature operation sub-raw material. The temperature operation sub-raw material brand q is selected according to conditions such as the positive/negative of the corrected temperature change amount and the sub-raw material charge amount restriction. In addition, the temperature operation sub-raw material brand q may be a single sub-raw material brand, or may be determined by totaling a plurality of sub-raw materials and brands.

In addition, the oxygen feeding amount in the target refining process may be calculated by calculating a difference between the past refining performance and the target refining process based on the refining process result including the molten metal component change amount in the past refining performance, the performance of the operation amount including the oxygen feeding amount and the sub-raw material charge amount, and the process target value including the target molten metal component in the target refining process and the scheduled operation amount including the scheduled charge amount of sub-raw material, by using the following Formula (5). When the temperature operation sub-raw material brand q has been determined as illustrated in Formulas (3) and (4), this is to be also taken into consideration.

$$\text{Oxygen feeding amount}[\text{Nm}^3]=\text{Oxygen feeding amount_past}[\text{Nm}^3]\times\text{Molten iron amount_target}[t]/\text{Molten iron amount_past}[t]+\Sigma_l\{\xi_l[\text{Nm}^3/(\text{kg}/t)]\times(\text{Scrap brand } l \text{ charge amount_target}[\text{kg}/t]-\text{Scrap brand } l \text{ charge amount_past}[\text{kg}/t])\}+\Sigma_m\{\eta_m[\text{Nm}^3/\%]\times(\text{Pre-process component } m \text{ concentration_target}[\%]-\text{Pre-process component } m \text{ concentration_past}[\%])\}+\Sigma_n\{\theta_n[\text{Nm}^3/\%]\times(\text{Post-process target component } n \text{ concentration_target}[\%]-\text{Post-process component } n \text{ concentration_past}[\%])\}+\Sigma_p\{\lambda_p[\text{Nm}^3/(\text{kg}/t)]\times(\text{Sub-raw material brand } p \text{ scheduled charge amount_target}[\text{kg}/t]-\text{Sub-raw material brand } p \text{ charge amount_past}[\text{kg}/t])\}+\Sigma_q\{\lambda_q[\text{Nm}^3/(\text{kg}/t)]\times\text{Temperature operation sub-Raw material } q \text{ charge amount}[\text{kg}]/\text{Entire input amount_target}[t]\} \quad (5)$$

However, ξ, η, θ, and λ are constants relating to each calculation item for the difference between the past refining performance and the target refining process condition, and the other variables and constants are similar to those used in Formulas (3) and (4). In Formulas (3) to (5), the temperature change amount or the oxygen feeding amount is expressed as a weighted sum of differences between past refining performance and target refining. However, when it is clear that the temperature change amount or the oxygen feeding amount has a non-linear relationship with respect to the difference of each calculation item, the temperature change amount or the oxygen feeding amount may be calculated using an appropriate function indicating the relationship. In addition, the constants of α, β, γ, δ, ε, ξ, η, θ, and λ may be determined so as to minimize an error between a true value of the temperature change amount or an optimum value of the oxygen feeding amount that becomes clear after the refining process and a calculated value thereof, or may be determined by a learning model using the true value of the temperature change amount or the optimum value of the oxygen feeding amount as training data.

Regarding the operation amount after the start of the refining process, for example, the operation amount is determined based on the past refining performance displayed on a guidance screen so as to follow a change curve of the reaction amount and the state amount in the refining furnace during the refining process in the past refining performance, and then the determined operation amount is transmitted to the control terminal 10. In the case of controlling the temperature of the molten metal 101, an optimum temperature transition curve of the temperature of the molten metal 101 during the refining process in the target refining process is calculated using a temperature rising efficiency obtained from the temperature change performance of the molten metal 101 in the past refining performance, and then, the charge amount of the heating material and the coolant are corrected or additional heating material or a coolant is charged so as to reduce the deviation between the temperature estimation value or the measurement value of the molten metal 101 during the refining process and the optimum temperature transition curve. In addition, in the case of controlling the oxygen efficiency for decarburization during the refining process, the height of the lance 102, the oxygen feeding rate, and the agitation gas flow rate are changed so as to reduce the deviation between the estimated value or the measured value of the oxygen efficiency for decarburization during the refining process in the target refining process and a change curve of the oxygen efficiency for decarburization in the past performance. The operation amount such as the charge amount of the heating material and the coolant after the start of the refining, and the change amount of the height of the lance 102, the oxygen feeding rate, and the agitation gas flow rate are calculated using a model representing a relationship between the control amount change such as the temperature of the molten metal 101 and the oxygen efficiency for decarburization and the operation amount. A model representing the relationship between the control amount change and the operation amount may use a model based on a physical law or an empirical rule, or may be derived from the relationship between the control amount change performance and the operation amount performance in the past refining performance. The control terminal 10 performs the refining process control based on the transmitted refining process condition. In addition, the information regarding the past refining performance extracted by the past similar performance extraction unit 16, the in-furnace reaction amount and the in-furnace state amount calculated by the model calculation unit 14, and the refining process condition determined by the operation amount determination unit 17 are transmitted to the display device 20. The display device 20 displays guidance for refining process control based on the transmitted information. This completes the process of Step S5 and a series of control processes.

As is apparent from the above description, in the refining process control device and the refining process control method according to an embodiment of the present invention, a past refining performance in which the refining process condition and the refining process performance acquired before the start of the refining process are similar to the refining process condition and the refining process performance as a calculation target and which has the highest refining process evaluation value, and then, the operation amount after the start of the refining process is determined based on the extracted performance. In addition, the refining process conditions and the refining process performance acquired before the start of the refining process include the result of the immediately preceding refining process in the refining facility, the elapsed time from the end of the immediately preceding refining process to the start of the target refining process, and information regarding the process performed during the elapsed time. With this configuration, even with various conditions and environments of the refining process such as a component and a temperature of molten iron to be input into the refining furnace, an amount of slag carried over from the immediately preceding process, and a state of the refining furnace, since the operation amount is determined in consideration of the influences of these, it is possible to execute a process similar to the satisfactory past process performance with high reproducibility with reduced variations for each process. Furthermore, in the determination of the operation amount, the operation amount is determined in consideration of the refining process condition similar to the satisfactory processing performance in the past as well as the correction amount for correcting the difference with the refining performance condition, with execution of a change in the operation amount before the start of the refining and the operation amount after the start of the refining. This makes it possible to achieve more accurate refining control by absorbing differences between refining processes by appropriately correcting different portions while approaching favorable past processing performance.

Example

Figure 3:
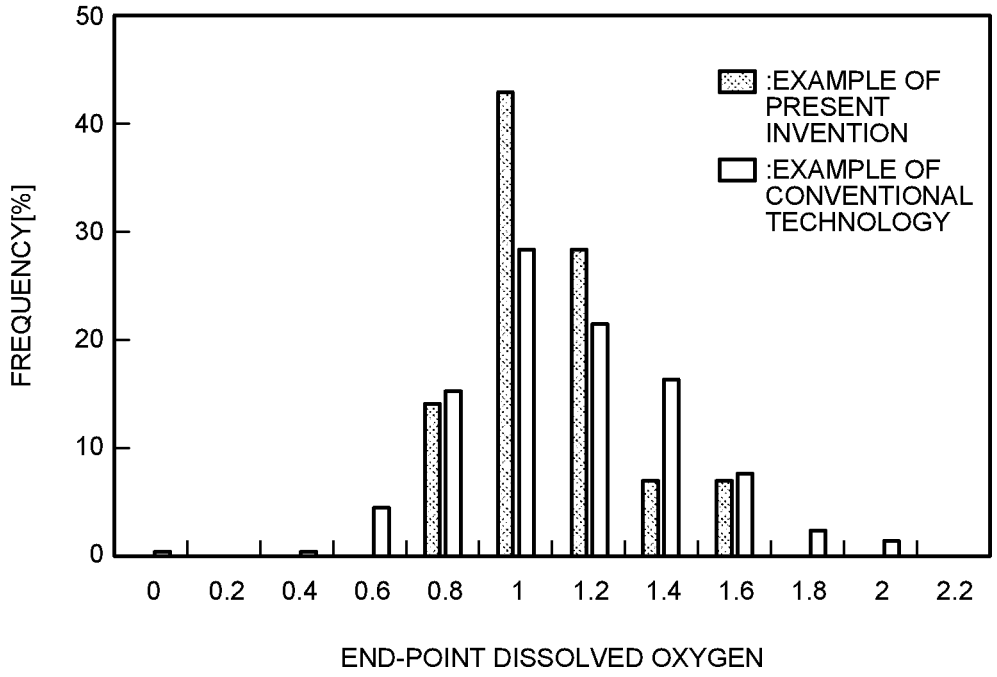
FIG. 3 is a diagram illustrating distributions of an end-point dissolved oxygen concentration of a molten metal in an example of the present invention and an example of the conventional technology.
Figure 4:
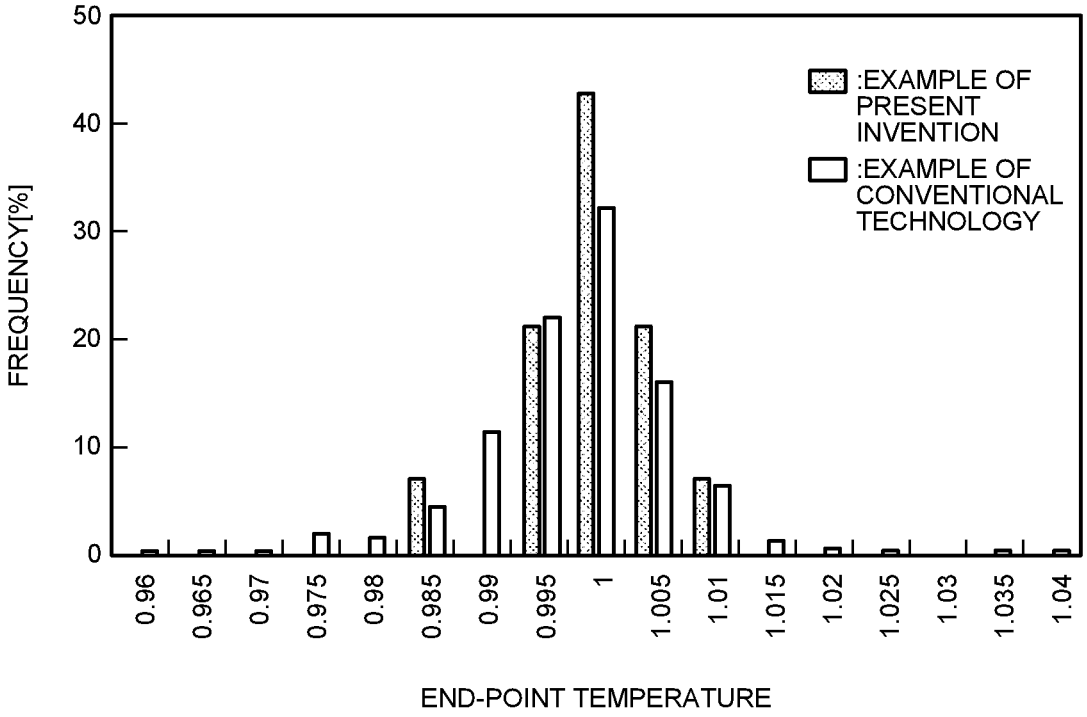
FIG. 4 is a diagram illustrating distributions of end-point temperatures of molten metal in an example of the present invention and an example of the conventional technology.

FIGS. 3 and 4 illustrate the results of evaluating the concentration of an end-point dissolved oxygen concentration and an end-point temperature in the molten metal for the case where the refining process was performed by performing the present invention (Example of the present invention) and the case where the refining process was performed without performing the present invention (Example of conventional technology), respectively. In addition, Table 1 below indicates: the mean (μ) and standard deviation (σ) of the end-point dissolved oxygen concentration/target dissolved oxygen concentration; the mean and standard deviation of the end-point temperature/target temperature; and an end-point accuracy improvement rate, in an example of the present invention and an example of a conventional technology. As is apparent from FIGS. 3 and 4 and Table 1, according to the example of the present invention, the variation in the end-point dissolved oxygen concentration and the end-point temperature of the molten metal is smaller than the case of the example of the conventional technology. With these results, it was confirmed that the variation for each process can be reduced according to the present invention.

TABLE 1

| | | Example of conventional technology | Example of present invention |
|---|---|---|---|
| End-point dissolved oxygen/ target dissolved oxygen | μ | 1.133 | 1.104 |
| | σ | 0.311 | 0.198 |
| End-point temperature/ target temperature | μ | 0.99805 | 1.00179 |
| | σ | 0.00888 | 0.00773 |
| End-point accuracy improvement rate | | 1 | 1.30 |

The embodiments to which the invention made by the present inventors is applied have been described as above. Note that the present invention is not limited by the description and drawings constituting a part of the disclosure of the present invention according to the present embodiments. For example, while the present embodiment is described as the refining process control device and the refining process control method targeted for a converter type refining furnace, the refining process control device and the control method according to the present invention can also execute a process similar to the satisfactory process performance in the past with high reproducibility even when the target is an electric furnace, a vacuum degassing facility, or the like. In this manner, other embodiments, examples, operation techniques, and the like made by those skilled in the art based on the present embodiment are all included in the scope of the present invention.

INDUSTRIAL APPLICABILITY

According to the present invention, it is possible to provide a refining process control device and a refining process control method capable of reducing variations for each process.

REFERENCE SIGNS LIST

1 REFINING PROCESS CONTROL DEVICE
2 REFINING FACILITY
CONTROL TERMINAL
11 INPUT DEVICE
12 REFINING PERFORMANCE DATABASE (REFINING PERFORMANCE DB)
13 ARITHMETIC PROCESSING UNIT
14 MODEL CALCULATION UNIT
REFINING PROCESS EVALUATION CALCULATION UNIT
16 PAST SIMILAR PERFORMANCE EXTRACTION UNIT
17 OPERATION AMOUNT DETERMINATION UNIT
DISPLAY DEVICE
100 CONVERTER
101 MOLTEN METAL
102 LANCE
103 SLAG
104 DUCT
105 EXHAUST GAS DETECTION UNIT
106 VENT HOLE
107 FLOWMETER

The invention claimed is:

1. A refining process control device comprising:

a model calculation unit configured to acquire, as input information, a performance value of a refining process condition in a refining facility, a measurement result of a temperature and a component concentration of a molten metal in the refining facility, measurement results related to a refining facility, including a flow rate of an exhaust gas discharged from the refining facility and a component concentration in the exhaust gas, and a result of an immediately preceding refining process in the refining facility, and calculates a reaction amount and a state amount in the refining facility during the refining process using the acquired input information;

a refining process evaluation calculation unit configured to calculate, using a weighted sum over at least one deviation of an actual molten metal component from a target molten metal component, an evaluation value of the refining process using the input information acquired by the model calculation unit or past input information, wherein the actual molten metal component includes a plurality of elemental components including C, Si, Mn and P;

a refining performance database configured to store the input information acquired by the model calculation unit, the reaction amount and the state amount calculated by the model calculation unit, and the evaluation value calculated by the refining process evaluation calculation unit;

a past similar performance extraction unit configured to extract, from the refining performance database, a performance value of a past refining process in which a refining condition being a refining process condition acquired before the start of the refining process and including a result of an immediately preceding refining process in the refining facility, is similar to a refining process condition as a calculation target and the evaluation value is the lowest or a plurality of top performances; and an operation amount determination unit configured to determine an initial operation amount at the start of a refining process based on the performance value of the past refining process extracted by the past similar performance extraction unit, and determine an operation amount based on a change amount of the initial operation amount after the start of the refining process.

2. The refining process control device according to claim 1, wherein the result of the immediately preceding refining process in the refining facility includes:

a molten metal temperature after the immediately preceding refining process;

a refining process result including a molten metal component and a slag component;

an elapsed time from the end of the immediately preceding refining process to the start of the target refining process; and information regarding a process performed during the elapsed time.

3. The refining process control device according to claim 1, wherein the input information includes information related to a state of the refining facility, the information related to the state of the refining facility comprising at least the number of times of use of the refining facility.

4. The refining process control device according to claim 1, wherein the refining process evaluation calculation unit is configured to calculate the evaluation value based on a cost of a sub-raw material charged during the refining process, a difference between a performance value and a target value of a temperature and a component concentration of the molten metal after the refining process, and an index representing refining process efficiency.

5. The refining process control device according to claim 1, wherein the past similar performance extraction unit is configured to calculate a distance between a vector representing features of the refining process condition and the refining process performance acquired before starting the refining process and a vector representing features of the refining process condition and the refining process performance as a calculation target, and extracts a performance value of a past refining process close in distance.

6. The refining process control device according to claim 1, wherein the operation amount determination unit is configured to determine an initial operation amount based on a past refining process result including a molten metal temperature change amount and a molten metal component change amount and a past operation amount performance, which have been extracted by the past similar performance extraction unit, and determine the operation amount, after start of the refining process, by changing the operation amount to follow transition of a reaction amount and a state amount during the refining process in the past refining performance extracted by the past similar performance extraction unit.

7. A refining process control method comprising:

a model calculation step of acquiring, as input information, a performance value of a refining process condition in a refining facility, a measurement result of a temperature and a component concentration of a molten metal in the refining facility, measurement results related to a refining facility, including a flow rate of an exhaust gas discharged from the refining facility and a component concentration in the exhaust gas, and a result of an immediately preceding refining process in the refining facility, and calculating a reaction amount and a state amount in the refining facility during the refining process using the acquired input information;

a refining process evaluation calculation step of calculating, using a weighted sum over at least one deviation of an actual molten metal component from a target molten metal component, an evaluation value of the refining process using the input information acquired by the model calculation step or past input information, wherein the actual molten metal component includes a plurality of elemental components including C, Si, Mn and P;

a storing step of storing, into a refining performance database, the input information acquired by the model calculation step, the reaction amount and the state amount calculated by the model calculation step, and the evaluation value calculated by the refining process evaluation calculation step;

a past similar performance extraction step of extracting, from the refining performance database, a performance value of a past refining process in which a refining condition being a refining process condition acquired before the start of the refining process and including a result of an immediately preceding refining process in the refining facility, is similar to a refining process condition as a calculation target and the evaluation value is-high the lowest or a plurality of top performances; and an operation amount determination step of determining an initial operation amount at the start of a refining process based on the performance value of the past refining process extracted by the past similar performance extraction step, and determining an operation amount based on a change amount of the initial operation amount after the start of the refining process.

* * * * *